US005449269A

United States Patent [19]

Frank et al.

[11] Patent Number: 5,449,269

[45] Date of Patent: Sep. 12, 1995

[54] AGGREGATE FOR FEEDING FUEL FROM A SUPPLY TANK TO INTERNAL COMBUSTION ENGINE OF MOTOR VEHICLE

[75] Inventors: Kurt Frank, Schorndorf; Juergen Treiber, Munich, both of Germany

[73] Assignee: Robert Bosch GmbH, Stuttgart, Germany

[21] Appl. No.: 222,471

[22] Filed: Apr. 1, 1994

[30] Foreign Application Priority Data

Jun. 1, 1993 [DE] Germany ..... 43 18 122.8

[51] Int. Cl.[6] ..... F04D 5/00

[52] U.S. Cl. ..... 415/55.1; 415/55.3

[58] Field of Search ..... 415/55.1, 55.2, 55.3, 415/55.4, 55.5, 55.6

[56] References Cited

U.S. PATENT DOCUMENTS

| | | | |
|---|---|---|---|
| 4,591,311 | 5/1986 | Matsuda et al. | 415/55.5 |
| 4,653,979 | 3/1987 | Schillinger | 415/55.6 |
| 5,160,249 | 11/1992 | Iwai et al. | 415/55.2 |
| 5,192,184 | 3/1993 | Nobuo et al. | 415/55.1 X |
| 5,215,429 | 6/1993 | Sun | 415/55.1 |
| 5,310,308 | 5/1994 | Yu et al. | 415/55.6 |
| 5,336,045 | 8/1994 | Koyama et al. | 415/55.1 |
| 5,338,151 | 8/1994 | Kemmner et al. | 415/55.1 |

FOREIGN PATENT DOCUMENTS

| | | | |
|---|---|---|---|
| 729453 | 11/1941 | Germany | 415/55.1 |
| 4020521 | 2/1992 | Germany . | |

*Primary Examiner*—Edward K. Look
*Assistant Examiner*—Michael S. Lee
*Attorney, Agent, or Firm*—Michael J. Striker

[57] ABSTRACT

An aggregate for feeding fuel from a supply tank to an internal combustion engine of a motor vehicle has a fluid pump having an impeller with a plurality of vanes distributed over its periphery on its both end surfaces, elements forming a pump chamber in which the impeller is rotated and including two wall parts limiting the pump chamber in direction of a rotary axis of the impeller at both sides and a housing part limiting the pump chamber in a radial direction, each of the wall parts having an end surface facing the impeller and being provided with a substantially ring-shaped feeding passage, at least one of the feeding passages having a connection with a suction side of the flow pump and at least the other of the feeding passages has a connection with a pressure side of the flow pump. The impeller and the housing part are arranged so that a radial gap between an outer surface of the impeller and an inner surface of the housing part at least in a peripheral region of the housing part in which the connection of the one feeding passage with the suction side is provided has such a size that a suction passage is formed through which the other feeding passage is also connected with the suction side of the flow pump. For limiting the suction passage in a peripheral direction near the suction passage, peripheral regions are arranged in which the radial gap is smaller.

9 Claims, 4 Drawing Sheets

AGGREGATE FOR FEEDING FUEL FROM A SUPPLY TANK TO INTERNAL COMBUSTION ENGINE OF MOTOR VEHICLE

BACKGROUND OF THE INVENTION

The present invention relates to an aggregate for feeding fuel from a supply tank to an internal combustion engine of a motor vehicle.

More particularly, it relates to a feeding aggregate with a flow pump having an impeller with a plurality of vanes rotatable in a pump chamber.

Feeding aggregates of the above mentioned general type are known. One of such aggregates is disclosed in the German reference DE 40 20 521 A1. This aggregate has a flow pump with an impeller having a plurality of vanes on its periphery at both end surfaces. The impeller is arranged in the pump chamber which is limited by a wall part in direction of the rotary axis of the impeller and also limited by a housing part in a radial direction. In the end faces of the wall part facing the impeller correspondingly ring-shaped feeding passages are formed. One of such feeding passages communicates through a suction opening with a suction side of the flow pump and the other feeding passage communicates through a pressure opening with the pressure side of the flow pump. An intermediate space is formed between the vanes of each end side, and the intermediate spaces of the vanes formed at both end sides are connected with one another through axial passages in the impeller.

In the region of the suction opening the fuel flows on the one hand directly in the feeding passage in which the suction opening opens, and on the other hand flows from it through the intermediate spaces and through the passages in the impeller to the feeding passage arranged at the opposite end surface of the impeller. Correspondingly, fuel flows directly from the feeding passage from which the pressure opening extends and also flows from the feeding passage arranged at the opposite end surface of the impeller, through the passages in the impeller and is discharged from it through the pressure opening. The passages through which the fuel flows between both end surfaces of the impeller represent throttling points which hinder the flow of the fluid and thereby worsen the efficiency of the flow pump. Since the whole inflow of the fuel is performed through one side of the impeller, in the suction region of the fuel pump there is a strong pressure drop, which especially in the case of high fuel temperatures contributes to the production of vapor bubbles which disturb the operation of the feeding aggregate.

SUMMARY OF THE INVENTION

Accordingly, it is an object of the present invention to provide a feeding aggregate of the above mentioned general type, which avoids the disadvantages of the prior art.

In keeping with these objects and with others which will become apparent hereinafter, one feature of the present invention resides, briefly stated, in a feeding aggregate in which a radial gap between an outer surface of an impeller and an inner surface of the housing part at least in a peripheral region of the housing part in which the connection of one feeding passage with the suction side is arranged has such a size that a suction passage is formed through which the other feeding passage is also connected with the suction side of the flow pump and for limiting the suction passage in the peripheral direction, in addition to the suction passage peripheral regions are arranged in which the radial gap is smaller.

When the feeding aggregate is designed in accordance with the present invention, it has the advantage that due to the direct connection of both feeding passages with the suction side of the flow pump, favorable flow conditions for the inflowing fuel are provided and thereby the efficiency of the flow pump is improved. The suction passage is limited by the housing part and the impeller moving relative to it. This simplifies the production since no expensive drilling or milling works are required. Moreover, due to the simultaneous inflow of fuel into both feeding passages a lower pressure drop in the suction region of the flow pump is provided, so that there less vapor bubbles are produced and the operational conditions of the feeding aggregate at high fuel temperatures is improved.

In accordance with a further feature of the present invention, due to the connection of both feeding passages directly with the pressure side of the flow pump the flow conditions in the flow pump are further improved and thereby also the efficiency of the aggregate is improved as well.

The suction passage and/or pressure passage can be formed in the inner surface of the housing part, which makes manufacture especially simple.

In accordance with a further feature of the present invention, the feeding passages are interrupted in a peripheral region between their connections with the suction and pressure side of the flow pump, and this peripheral region is formed with a sealing region, and the radial gap in the sealing region is smaller than in the suction passage and in the pressure passage. This construction provides an efficient withdrawal of the gas bubbles.

In accordance with still a further feature of the present invention, the end surfaces of the wall part which face the impeller are formed in the sealing region with an unloading passage connected with a region in which a low pressure acts, and in the peripheral region of the housing part in which the unloading passages are arranged the radial gap between the outer surface of the impeller and the inner surface of the housing part is of such a size that a connecting passage which connects an unloading passage with the low pressure region is formed. This construction of the impeller further improves the efficiency of the flow pump.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
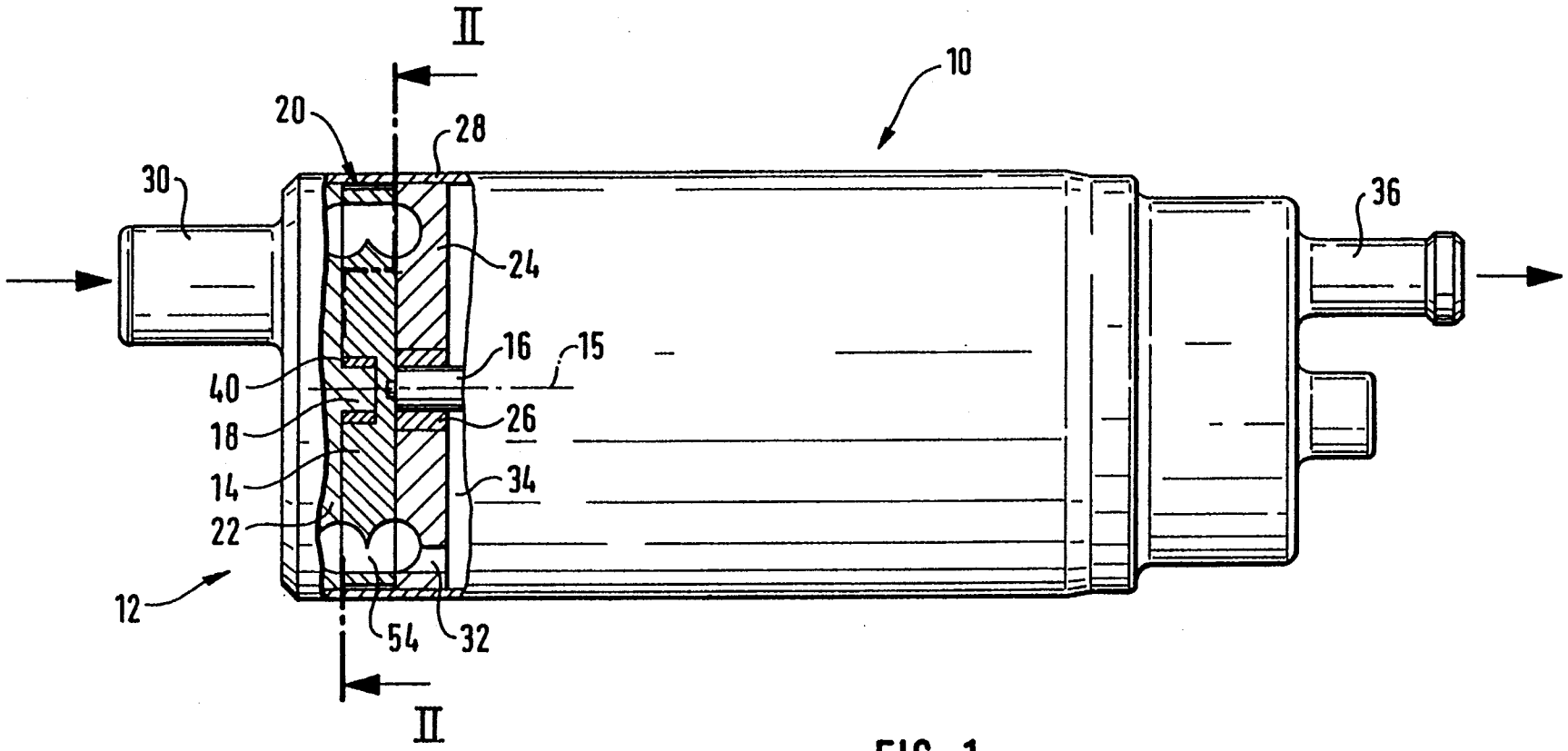
FIG. 1 is a view showing a fuel feeding aggregate with a peripheral pump in accordance with the present invention in a longitudinal section.

An aggregate 10 shown in FIG. 1 serves for feeding fuel from a not shown supply tank to a not shown internal combustion engine of a motor vehicle. The fuel feeding aggregate 10 has a flow pump 12 with an impeller 14 which is connected with a drive shaft 16 of a not shown electric drive motor.

The impeller 14 is arranged on a bearing pin 18 and located in a so-called pump chamber 20 limited at both sides in direction of the rotary axis of the impeller 14 by wall parts 22 and 24. The bearing pin 18 is arranged on the wall part 22 and the wall part 24 has a bearing point 26 for the drive shaft 16. In the radial direction relative to the rotary axis 15 of the impeller 14 the pump chamber 20 is limited by a cylindrical housing part 28. During the operation of the feeding aggregate 10 the flow pump 12 sucks the fuel through a suction pipe 30 and pumps it through a pump outlet 32 in the wall part 24 to a chamber 34 in which the not shown electric motor is arranged. From there fuel is supplied through an output or pressure pipe 36 to the internal combustion engine.

Figure 2:
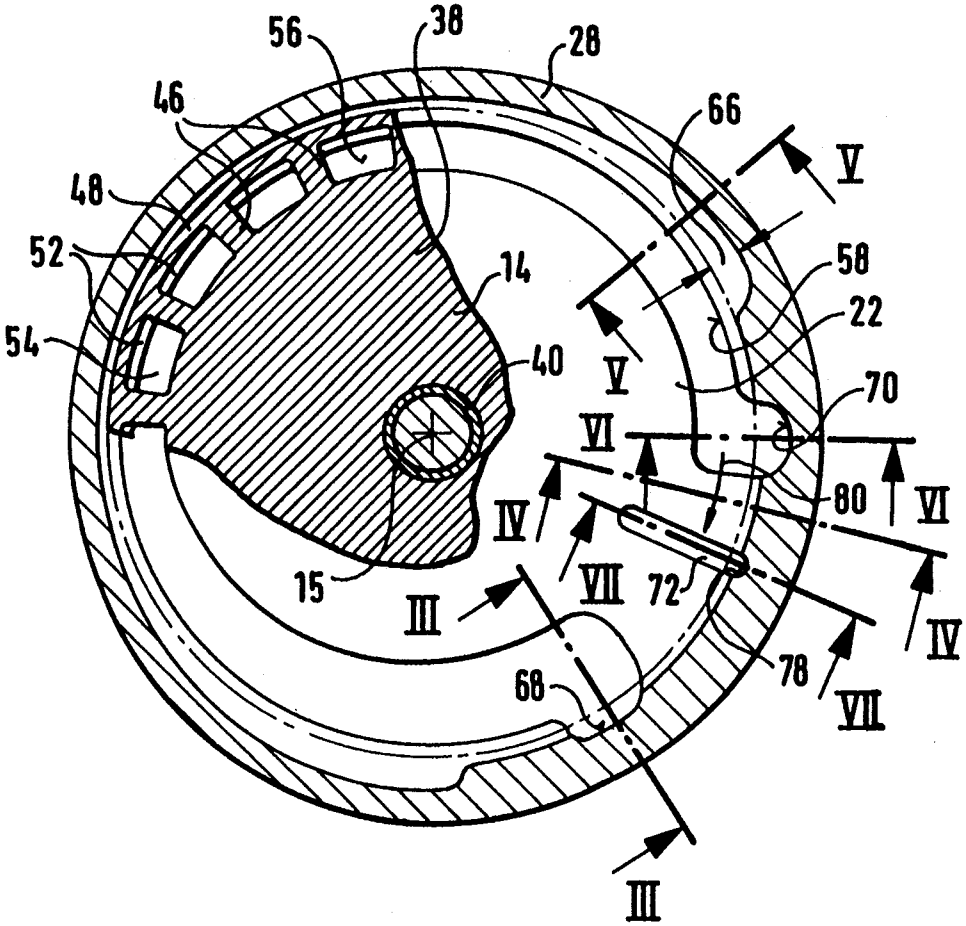
FIG. 2 is a view showing a cross-section through a peripheral pump taken along the line II—II in FIG. 1.

The impeller 14 of the flow pump 12 has a disc-shaped central region 38, as shown in FIG. 2. It is provided with a central bearing bushing 40 for supporting the bearing pin 18. The impeller 14 at its both end surfaces 42 and 44 has a plurality of vanes 46 extending substantially radially relative to the rotary axis 15 and uniformly distributed over the periphery of the impeller 14 at distances therebetween. The vanes 46 are connected by a ring 48 at their radially outwardly extending ends. A wall 50 extends starting from the radially inner ends of the vanes 46 substantially in the center of the width of the impeller 14 in direction from its rotary axis 15, substantially radially between two vanes 46. The walls 50 extend radially outwardly not to the ring 48, so that passages 52 are provided to form a connection between both end surfaces 42 and 44 of the impeller 14.

An intermediate chamber or a gap 54 is formed correspondingly between two neighboring vanes 46 and is groove-shaped as considered in the longitudinal section through the flow pump 12. Starting from the end surfaces 42 or 44 of the impeller 14, the groove bottom 56 of the gap 54 is formed as a circular segment. The circular segment 56 extending from both end surfaces 42 and 44 merges into one another in the region of the wall 50 smoothly. A substantially ring-shaped feeding passage 58 and 60 is formed correspondingly in the end surfaces of both wall parts 22 and 24 which face the impeller 14, at the same distance from the rotary axis 15 of the impeller 14 as the vanes 46. The feeding passages 58 and 60 extend not through a closed ring, but instead are interrupted through a part of the periphery. A suction opening 62 connected with the suction pipe 30 and thereby with the suction side of the flow pump 18 opens at a peripheral end of one feeding passage 58, while a pressure opening 64 connected with the pump outlet 32 and thereby with the pressure side of the flow pump 12 leads from the other peripheral end of the other feeding passage 60. The peripheral region 59 of the wall portions 22 and 24 interrupted by the feeding passages 58 and 60 serves a sealing region for preventing an overflow of fuel from the pressure end of the feeding passages to their suction side end. A minimum gap between the end surfaces of the wall parts 22, 24 and the end surfaces 42 and 44 of the impeller 14 are provided in the peripheral region 59 for sealing. The base of the feeding passages 58 and 60 is also formed as a circular segment similar to the groove base 56 of the gaps 54 of the impeller 14 as considered in a longitudinal section through the flow pump 12.

Figure 3:
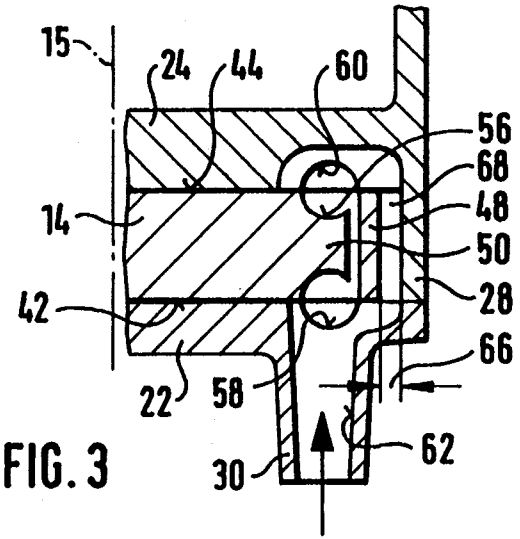
FIGS. 3–7 are views showing longitudinal sections through the peripheral pump along the lines III—III to VII—VII in FIG. 2.
Figure 4:
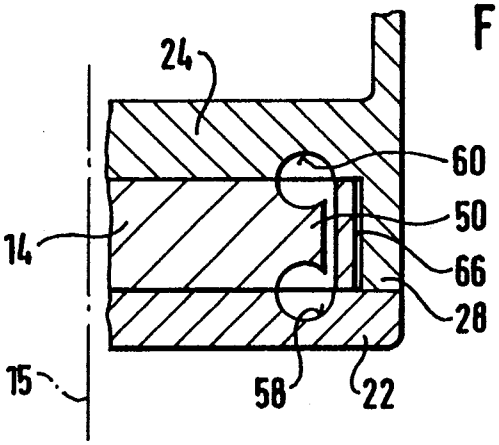
Figure 5:
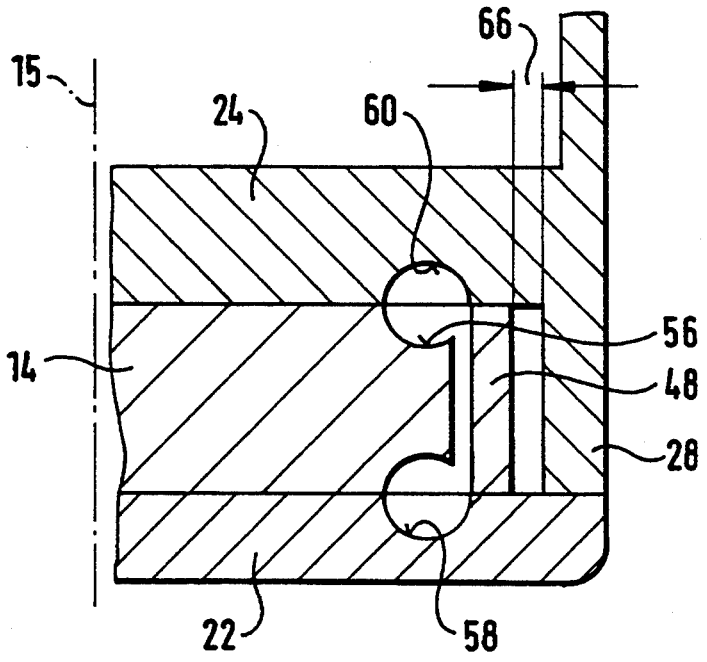

As can be seen from FIGS. 2 and 3, a radial gap 66 remains between the ring 48 of the impeller 14 which connects the outer surfaces of the vanes 46 and the housing part 28 which limits in the radial direction the inner surface of the pump chamber 20. The gap 66 is not constant over the periphery of the impeller 14. In the peripheral region of the housing part 28 in which the Suction opening 62 is formed in the wall part 22, the radial gap 66 has such a size that here a suction passage 68 is formed. The suction passage 68 connects the feeding passage 60 in which the suction opening 62 does not open, with the suction pipe 30 and thereby as the feeding passage 58 directly with the suction side of the flow pump 12. The feeding passage 60 is increased outwardly from the rotary axis 15 in the peripheral region of the suction passage 68 in the radial direction so that it is connected with the suction passage 68. The suction passage 68 is formed therefore in the inner surface of the housing part 28 and extends substantially parallel to the rotary axis 15 of the impeller 14. The radial gap 66 before and after the suction passage 68 in the peripheral direction, as shown in FIGS. 2 and 4, is substantially smaller, so that the suction passage 68 is limited in the peripheral direction. The reduction of the radial gap 66 is obtained in that the inner surface of the housing part 28 extends in the radial direction approximately to the outer surface of the impeller 14. The suction passage 68 is formed in the housing part 28 and requires no post-machining on the housing part 28. Over the remaining periphery of the impeller 14 the radial gap 66, as shown in FIGS. 2 and 5, can be formed relatively great, and here however the gap 66 has no connection with the feeding passages 58 and 60. The inner surface of the housing part 28 can remain not machined in this peripheral region, which simplifies the manufacture of the housing part 28.

Figure 6:
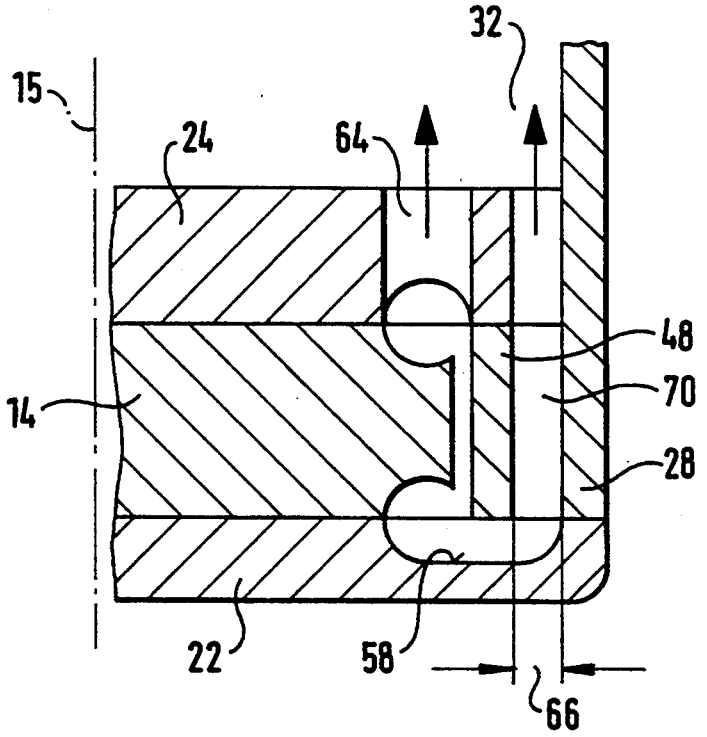
Figure 7:
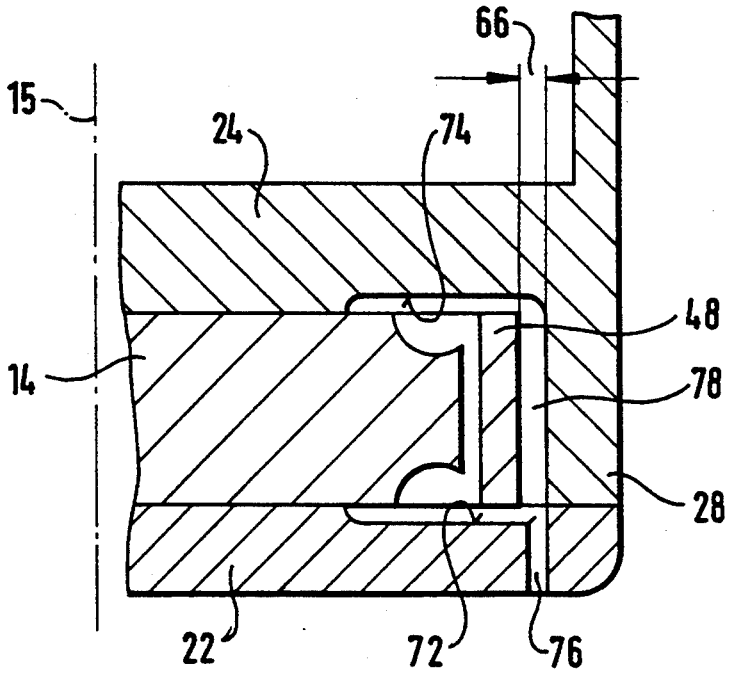

In this embodiment in the peripheral region of the housing part 28 in which the pressure opening 64 in the wall part 24 extends from the feeding passage 60, the radial gap 66 as shown in FIGS. 2 and 6 has a such a size that there the feeding passage 58 from which the pressure opening 64 does not extend is formed with a pressure passage 70 connected with the pump outlet 32 and thereby directly with the pressure side of the flow pump 12. The feeding passage 58 in the peripheral region of the pressure passage 70 is increased in the radial direction outwardly from the rotary axis 15 so that it is connected with the pressure passage 70. The pressure passage 70 extends in the wall part 24 to the pump outlet 32, and can however open also in the pressure opening 64. The pressure passage 70 is formed, as the suction passage 68 in the inner surface of the housing part 28 and extends substantially parallel to the rotary axis 15 Of the impeller 14. The radial gap 56 in the peripheral direction before and after the pressure passage 70, as shown in FIG. 2, is substantially smaller so that the pressure passage 70 is limited in the peripheral direction.

Unloading passages 72 and 74 are formed in the peripheral region 59 operating as a sealing region between the suction opening 62 and the pressure opening 64 in the end surfaces of the wall parts 22 and 24 facing the impeller 14. The unloading passages 72 and 74 extend substantially radially relative to the rotary axis 15 of the impeller 14 over the same radial region as the suction opening 62 and the pressure opening 64. The unloading passage 72 is connected through an opening 76 in the wall part 22 with a region in which a low pressure acts, in the embodiment with the supply tank. In the peripheral region of the housing part 28 in which the unloading passages 72 and 74 are formed in the wall parts 22 and 24, the radial gap 66 has such a size that a connecting passage 78 is formed between both unloading passages 72 and 74 and thereby the unloading passage 74 is connected through the connecting passage 76 also with a region in which the low pressure acts.

The connecting passage 78 can also be formed so that it connects the unloading passage 74 directly, or in other words, without cooperation with the unloading passage 72 with the low pressure region.

Because of the unavoidable gap between the end surfaces of the wall parts 22, 24 and the end surfaces 42, 44 of the impeller 14, during the operation of the feeding aggregate 10 leakage fuel flows from the pressure region of the feeding passages 58, 60 in the peripheral region of the pressure opening 64 and eventually available gas bubbles flow in direction of the arrow 80 to the suction region of the feeding passages 58, 60 in the peripheral region of the suction opening 62. The leakage fuel and the gas bubbles are pressed in the unloading passages 72 and 74 and flow out from them into the low pressure region in the embodiment with a supply tank, and therefore are retained far from the suction region of the flow pump 12. A peripheral region with a small radial gap 66 is formed between the connecting passage 78 and the suction passage 68 as well as the pressure passage 70, respectively, for limiting these passages relative to one another in a peripheral direction.

Figure 8:
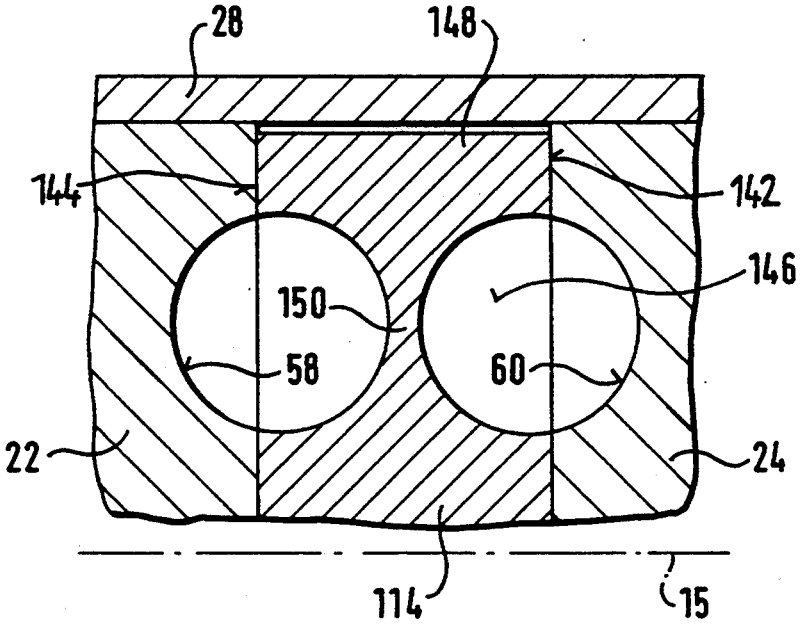
FIG. 8 is a view showing a longitudinal section through the peripheral pump with an impeller in accordance with another embodiment different from FIG. 1.

FIG. 8 shows an embodiment of the impeller 114 which is different from the embodiment of the impeller 14 shown in FIG. 1. The impeller and all remaining parts of the feeding aggregate are formed as described hereinabove. In the different embodiment of the impeller 114 with the wall 150 extends substantially in the center of the width of the impeller 114 in direction from its rotary axis 15 from the radially inner end of the vanes 146 facing the rotary axis 15 to the ring 148. Thereby the both end surfaces 142 and 144 of the impeller 114 are completely separated by the walls 150 and a connection between both feeding passages 58 and 60 is produced in the region of the suction passage 68 and the pressure passage 70, and a connection between both unloading passages 72 and 74 is produced in the region of the connecting passage 78. This is possible since both feeding passages 58 and 60 are connected both directly with the suction side and also with the pressure side of the flow pump 12.

It will be understood that each of the elements described above, or two or more together, may also find a useful application in other types of constructions differing from the types described above.

While the invention has been illustrated and described as embodied in an aggregate for feeding fuel from a supply tank to an internal combustion engine of a motor vehicle, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An aggregate for feeding fuel from a supply tank to an internal combustion engine of a motor vehicle, comprising a flow pump having an impeller with a plurality of vanes distributed over its periphery on its both end surfaces; a ring connecting said vanes at their radially outwardly extending ends; means forming a pump chamber in which said impeller is rotated and including two wall parts limiting said pump chamber in direction of a rotary axis of said impeller at both sides and a housing part limiting said pump chamber in a radial direction, each of said wall parts having an end surface facing said impeller and being provided with a substantially ring-shaped feeding passage, at least one of said feeding passages having a connection with a suction side of said flow pump and at least the other of said feeding passages having a connection with a pressure side of said flow pump, said impeller and said housing part being arranged so that a radial gap is formed between an outer surface of said ring connecting the vanes of said impeller and an inner surface of said housing part, and a suction passage is formed at least in a peripheral region of said housing part in which said connection of said one feeding passage with said suction side is provided, said other feeding passage being also connected through said suction passage with said suction side of said flow pump, said suction passage being limited in a circumferential direction on both sides of said suction passage by said radial gap which is smaller in peripheral regions before and after said suction passage than in a peripheral region in which said suction passage is located, wherein said suction passage constitutes the only connection of said other feeding passage with said suction side of said flow pump over the outer surface of said ring.

2. A feeding aggregate as defined in claim 1, wherein said radial gap between said outer surface of said ring connecting the vanes of said impeller and said inner surface of said housing part in said peripheral region of said housing part in which said connection of said other feeding passage with said pressure side is arranged, is increased so that a pressure passage is formed through which said one feeding passage is also connected with said pressure side of said flow pump, said pressure passage being limited in a circumferential direction on both sides of said pressure passage by said radial gap which is smaller in peripheral regions before and after said pressure passage than in a peripheral region in which said pressure passage is located, wherein said pressure passage constitutes the only connection of said one feeding passage with said pressure side of said flow pump over the outer periphery of said ring.

3. A feeding aggregate as defined in claim 2, wherein at least one of said suction passage and said pressure passage is formed in said inner surface of said housing part.

4. A feeding aggregate as defined in claim 2, wherein at least one of said suction passage and said pressure passage extends substantially parallel to said rotary axis of said impeller.

5. A feeding aggregate as defined in claim 1, wherein said feeding passages in a region between said connections with said suction side and said pressure side of said flow pump are interrupted, said region in which said feeding passages are interrupted being formed as a sealing region, said radial gap in said sealing region being smaller than in said suction passage and in said pressure passage.

6. A feeding aggregate as defined in claim 5, wherein each of said end surfaces of said wall parts facing said impeller has, in said sealing region an unloading passage which is connected with a region, in which a low pressure acts, said radial gap between said outer surface of said impeller and said inner surface of said housing part having such a size in a peripheral region of said housing part in which said unloading passages are arranged that a connecting passage which connects one of said unloading passages with said low pressure region is formed.

7. A feeding aggregate as defined in claim 1; and further comprising a wall extending from inner ends of said vanes which face radially inwardly toward said rotary axis of said impeller to radial outer ends of said vanes and separating said vanes formed on said end surfaces of said impeller in direction of said rotary axis of said impeller from one another.

8. A feeding aggregate as defined in claim 1, wherein at least one of said suction passage and said pressure passage is formed in said inner surface of said housing part.

9. A feeding aggregate as defined in claim 1, wherein at least one of said suction passage and said pressure passage extends substantially parallel to said rotary axis of said impeller.

* * * * *